US010403196B2

(12) United States Patent
Shin et al.

(10) Patent No.: US 10,403,196 B2
(45) Date of Patent: Sep. 3, 2019

(54) SOURCE DRIVER INCLUDING SENSING CIRCUIT AND DISPLAY DEVICE USING THE SAME

(71) Applicant: SILICON WORKS CO., LTD., Daejeon (KR)

(72) Inventors: Ju Young Shin, Daejeon (KR); Jung Bae Yun, Daejeon-si (KR); Yong Jung Kwon, Cheongju-si (KR); Jeung Hie Choi, Cheongju-si (KR)

(73) Assignee: SILICON WORKS CO., LTD. (KR)

( * ) Notice: Subject to any disclaimer, the term of this patent is extended or adjusted under 35 U.S.C. 154(b) by 15 days.

(21) Appl. No.: 15/181,577

(22) Filed: Jun. 14, 2016

(65) Prior Publication Data

US 2016/0379548 A1 Dec. 29, 2016

(30) Foreign Application Priority Data

Jun. 29, 2015 (KR) ..... 10-2015-0092070

(51) Int. Cl.
*G09G 3/20* (2006.01)
*G09G 3/00* (2006.01)

(52) U.S. Cl.
CPC ..... *G09G 3/2096* (2013.01); *G09G 3/006* (2013.01); *G09G 3/20* (2013.01); *G09G 2310/0275* (2013.01); *G09G 2330/12* (2013.01)

(58) Field of Classification Search
CPC ..... G09G 3/2096
USPC ..... 345/214
See application file for complete search history.

(56) References Cited

U.S. PATENT DOCUMENTS

2004/0032278 A1* 2/2004 Orii ..... G02F 1/136259 324/760.02
2005/0270059 A1* 12/2005 Ando ..... G09G 3/006 324/760.01
2009/0027314 A1* 1/2009 Kohno ..... G09G 3/3233 345/76
2010/0201903 A1* 8/2010 Huang ..... G02F 1/136259 349/55

FOREIGN PATENT DOCUMENTS

KR 10-0604918 7/2006
KR 10-2012-0114990 10/2012
KR 10-2014-0141375 12/2014
KR 10-2015-0051462 5/2015

* cited by examiner

*Primary Examiner* — Long D Pham
(74) *Attorney, Agent, or Firm* — Polsinelli PC

(57) ABSTRACT

Disclosed is a source driver including a sensing circuit capable of sensing whether a short occurred between a data output line and a power line. The source driver may include: an output circuit configured to output a preset voltage to a display panel in a checking mode; and a sensing circuit configured to sense whether data output lines connecting the output circuit and the display panel are shorted, using the preset voltage, and output a sensing result signal.

16 Claims, 9 Drawing Sheets

SOURCE DRIVER INCLUDING SENSING CIRCUIT AND DISPLAY DEVICE USING THE SAME

BACKGROUND

1. Technical Field

The present disclosure relates to a display device, and more particularly, to a technology for sensing whether a short occurred in the display device.

2. Related Art

In general, a display device includes a display panel, a gate driver, a source driver and a timing controller.

The display panel includes a plurality of gate lines and a plurality of data lines, and the gate driver supplies a gate driving voltage to a gate line. The source driver supplies a data voltage to a data line, and the timing controller provides a data signal to the source driver.

The source driver receives a data signal from the timing controller, and provides a data voltage corresponding to the data signal to the display panel.

The source driver includes a receiver configured to receive a data signal from the timing controller, a digital-analog converter configured to convert the data signal into a data voltage, and an output circuit configured to output the data voltage to the display panel.

Some display panels receive an external voltage through power lines passing through the source driver. The power lines are installed between data output lines of the source driver, and the interval between the power lines and the data output lines in the source driver is set to a very small value.

Recently, however, since display panels are manufactured in a curved shape and the interval between data output lines and power lines is set to a very small value, a short may occur between a power line and a data output line in the source driver due to a thermal expansion coefficient, assembly defect or handling.

When a short occurs between a power line and a data output line, the display panel may be damaged or burnt out. Thus, there is a demand for a circuit capable of checking whether a short occurred between a power line and a data output line in the source driver.

SUMMARY

Various embodiments are directed to a source driver including a sensing circuit capable of sensing whether data output lines are shorted, and a display device including the same.

Also, various embodiments are directed to a source driver capable of preventing a subsequent damage such as a burn-out of a display panel when a short occurred, and a display device including the same.

In an embodiment, a source driver may include: an output circuit configured to output a preset voltage to a display panel in a checking mode; and a sensing circuit configured to sense whether data output lines connecting the output circuit and the display panel are shorted, using the preset voltage, and output a sensing result signal.

In an embodiment, a source driver may include: a share line configured to share data output lines connecting an output circuit and a display panel; and a sensing circuit configured to apply a preset voltage to the share line in a checking mode, check a potential change of the share line so as to sense whether the data output lines are shorted, and output a sensing result signal.

In an embodiment, a display device may include: a source driver configured to share voltages of data output lines in a checking mode; and a sensing circuit configured to check a potential change of the shared voltage of the data output lines in the checking mode, and sense whether the data output lines are shorted.

DETAILED DESCRIPTION

Figure 1:
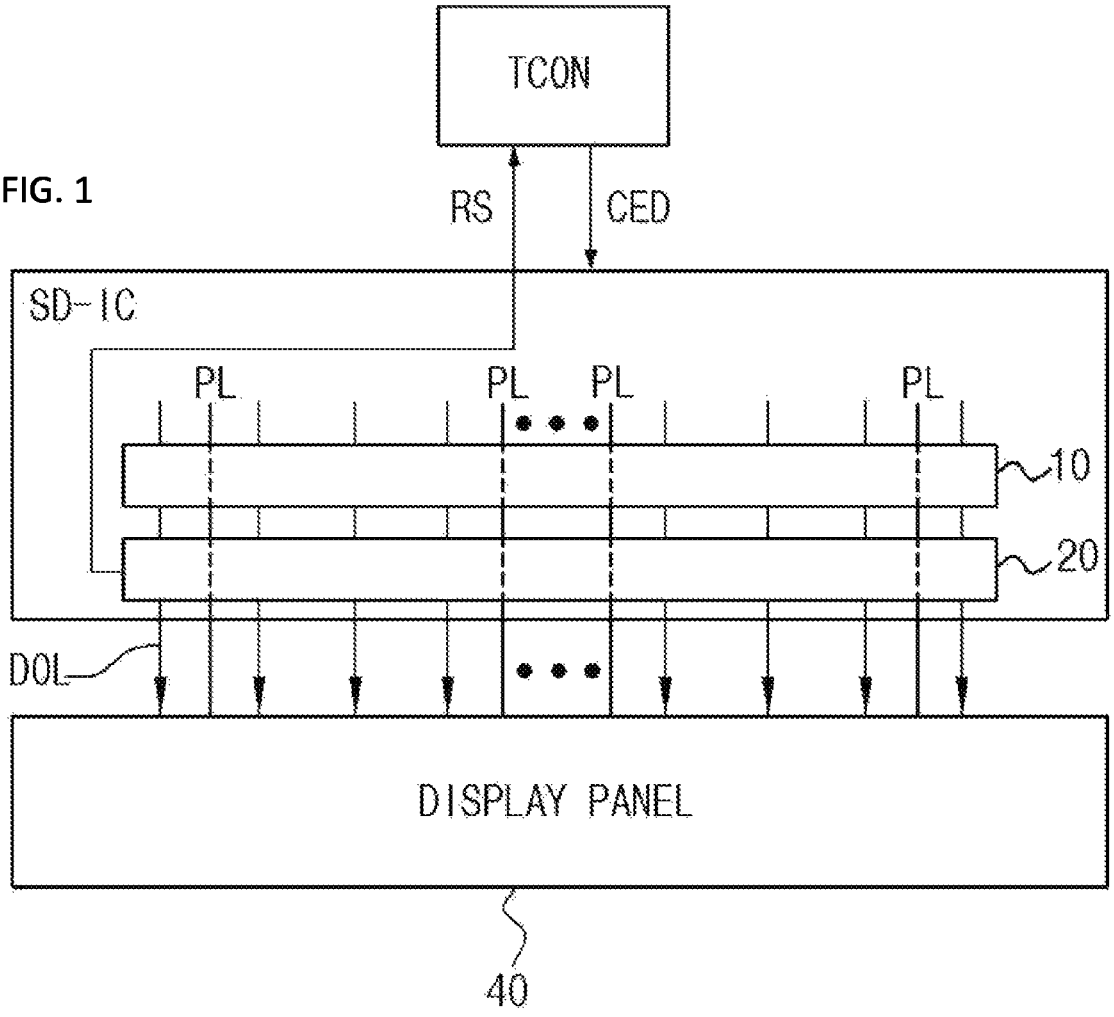
FIG. 1 is a block diagram illustrating a display device according to an embodiment of the present invention.

Hereafter, embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

Figure 2:
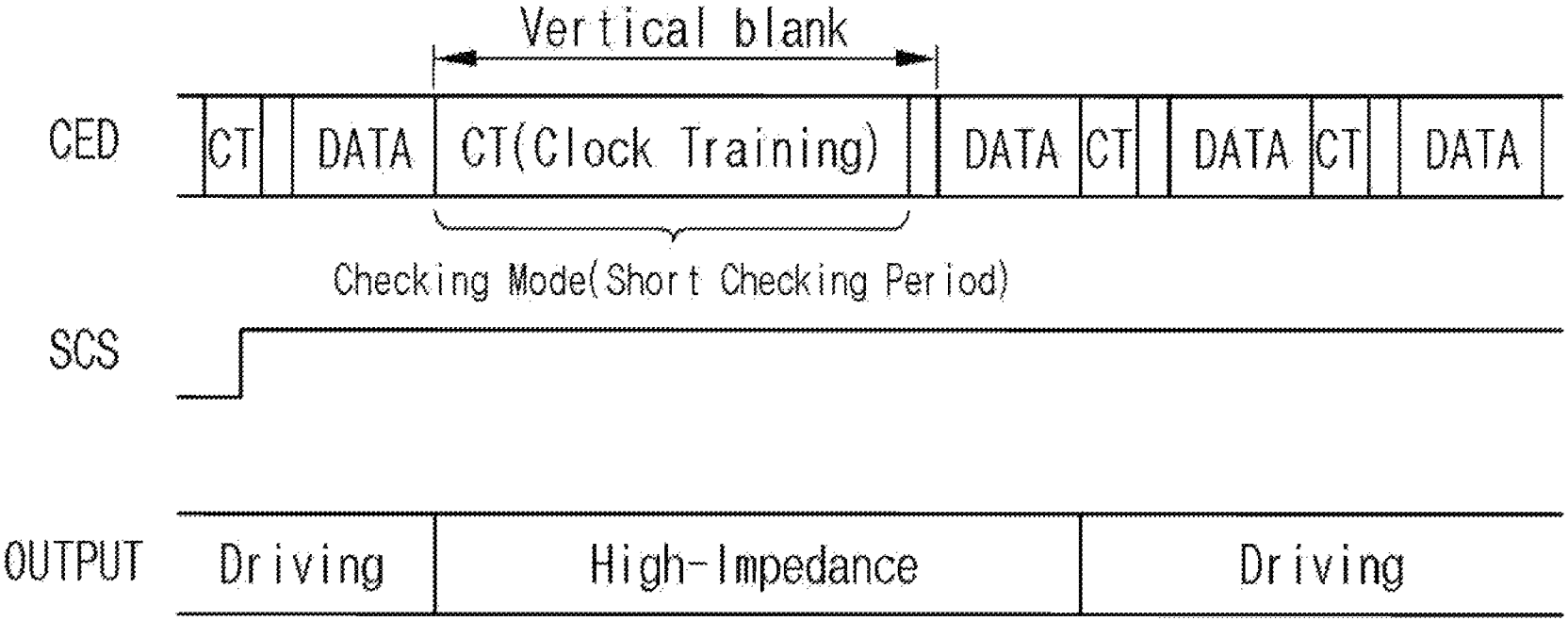
FIGS. 2 and 3 are timing diagrams for describing the operation of the display device of FIG. 1.
Figure 3:
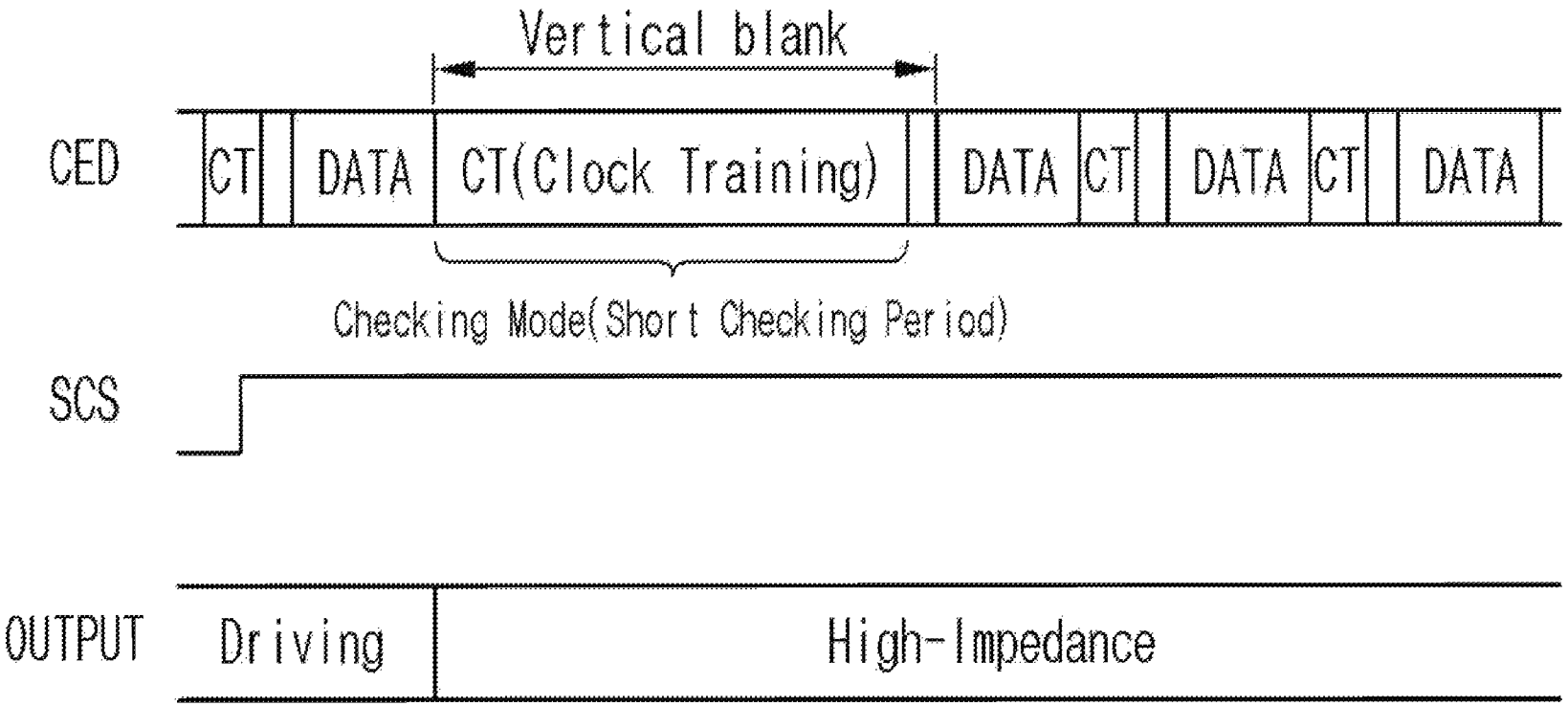

FIG. 1 is a block diagram illustrating a display device according to an embodiment of the present invention, and FIGS. 2 and 3 are timing diagrams for describing the operation of the display device of FIG. 1.

Referring to FIGS. 1 and 2, the display device may include a timing controller TCON and a source driver SD-IC.

The timing controller TCON provides an input signal CED (Clock Embedded DATA) to the source driver SD-IC, the input signal CED including a control signal for enabling a checking mode. The checking mode may be defined as a mode for checking whether data output lines DOL of the source driver SD-IC are shorted. For example, as illustrated in FIG. 2, a vertical synchronization period (vertical blank) for synchronization of the display device may be used as the checking mode.

The input signal CED may be provided through a CEDS (Clock Embedded Data Signaling) protocol in which a clock signal is embedded between data signals DATA. The input signal CED is transmitted with different formats during a CT (Clock Training) period and a data transmission period. The input signal CED has a format including only a clock signal CLK at the CT period, and has a clock embedded data format at the data transmission period.

The data signal DATA may include an image data signal and a control signal SCS (Short Checking Signal) for enabling the checking mode. The source driver SD-IC can not only receive the control signal SCS from the timing controller TCON, but also generate the control signal SCS therein, in order to enable a function of sensing whether a data output line DOL is shorted.

The source driver SD-IC receives the input signal CED from the timing controller TCON, recovers the data signal DATA and the clock signal from the input signal CED, senses a short between a data output line DOL and a power line PL in the checking mode in response to the control signal RSC included in the data signal DATA, and provides a sensing result signal RS (Result Signal) to the timing controller TCON. The power line PL serves to provide power to the display panel 40.

The source driver SD-IC includes an output circuit 10 and a sensing circuit 20 to sense whether a short occurred between a data output line DOL and a power line PL.

For example, the sensing circuit 20 may sense voltages of the data output lines DOL, compare a shared voltage of the sensed voltages to a preset reference voltage so as to sense whether a short occurred, and provide the sensing result signal RS to the timing controller ICON.

For another example, the sensing circuit 20 may sense voltages of the data output lines DOL, and provide a sensing result signal RS to the timing controller ICON, the sensing result signal RS being obtained by converting a shared voltage of the sensed voltages into a digital signal. At this time, the sensing circuit 20 may be configured to provide the sensing result signal RS through an analog-digital converter which provides pixel sensing data of the display panel 40 to the timing controller ICON.

Referring to FIGS. 1 and 3, the timing controller ICON receives the sensing result signal RS from the source driver SD-IC, the sensing result signal RS indicating whether a data output line DOL is shorted, determines whether the source driver SD-IC is shorted in response to the sensing result signal RS, and shuts down the source driver SD-IC which is determined to be shorted.

For example, as illustrated in FIG. 3, the timing controller ICON may control the shorted source driver SD-IC to have a high-impedance output state. The source driver SD-IC may be controlled according to the input signal CED having the control signal embedded therein or through a separate control line between the timing controller and the source driver.

The source driver SD-IC according to the present embodiment may check whether the data output lines DOL are shorted. Furthermore, when a short occurred shut down, the source driver SD-IC may be shut down by the timing controller TCON. Thus, the source driver SD-IC can prevent a burn-out of the display panel 40, which may occur due to a short between the data output line DOL and the power line PL.

In another embodiment, the source driver SD-IC checks whether a data output line DOL is shorted, and cuts off the data output line DOL regardless of the operation of the timing controller TCON, when the data output line DOL is shorted, thereby preventing a subsequent damage such as a burn-out of the display panel 40. The configuration in which the source driver SD-IC cuts off data output when a short occurred will be described below with reference to FIG. 9.

Figure 4:
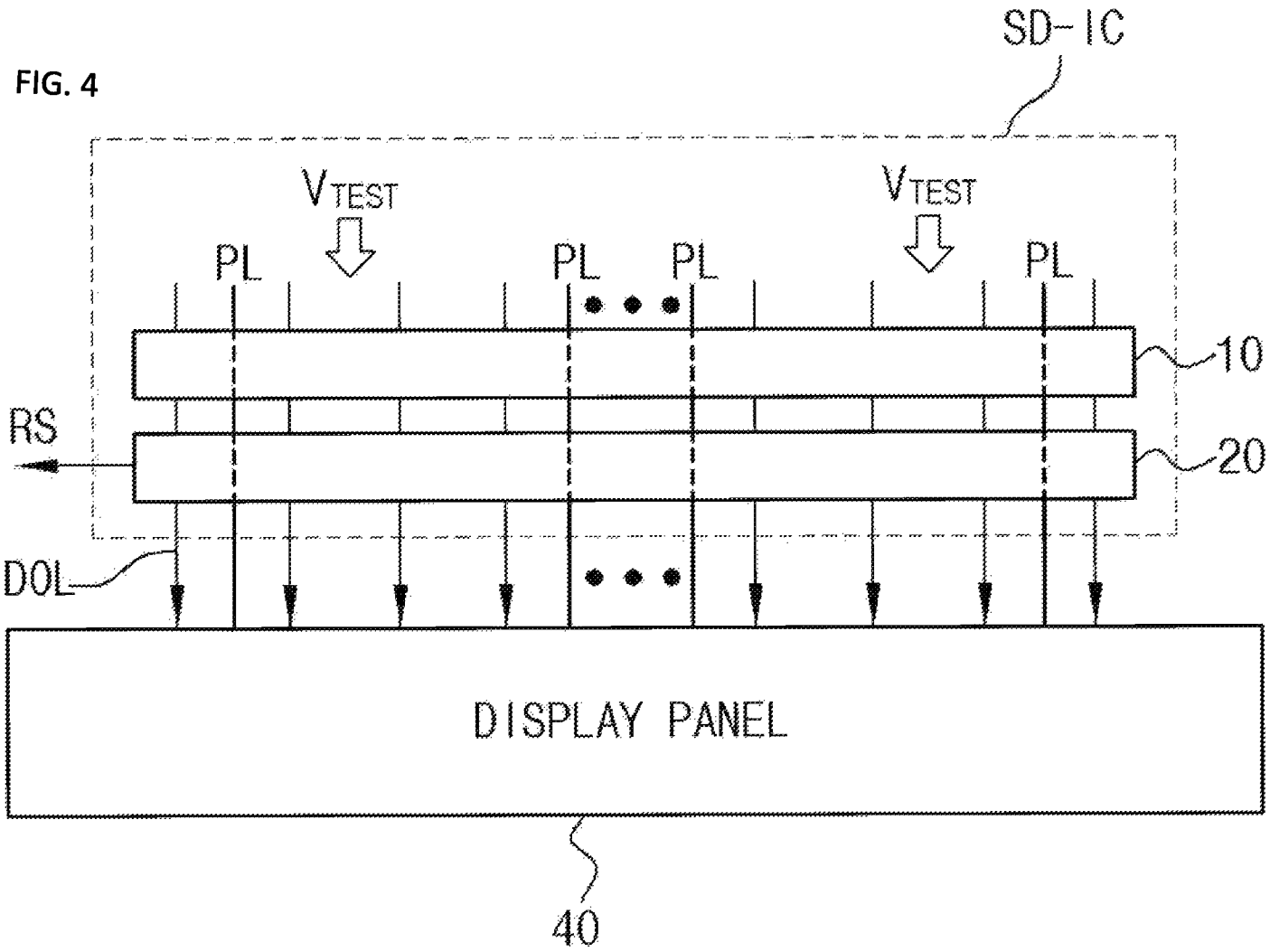
FIG. 4 is a block diagram illustrating a source driver including a sensing circuit according to the embodiment of the present invention.

FIG. 4 is a block diagram illustrating the source driver SD-IC including the sensing circuit 20 according to the embodiment of the present invention.

Referring to FIG. 4, the source driver SD-IC includes the output circuit 10 and the sensing circuit 20. The source driver SD-IC may include a recovery circuit and a digital-analog converter which are not illustrated. The recovery circuit recovers a data signal DATA and a clock signal from an input signal CED received from the timing controller TCON, and the digital-analog converter converts a pixel data signal contained in the recovered data signal DATA into a corresponding data voltage (gray voltage), and provides the data voltage to the output circuit 10.

The output circuit 10 buffers the data voltage and provides the buffered voltage to the display panel 40. The output circuit 10 and the display panel 40 are connected through the data output lines DOL, and the data output lines DOL are connected to corresponding data lines formed in the display panel 40.

The output circuit 10 receives a test voltage VTEST preset to the data voltage in the checking mode, and provides the test voltage VTEST to the data output lines DOL. The checking mode is defined as a period for sensing whether the data output lines DOL are shorted. For example, a vertical synchronization period for synchronization of the display device may be used as the checking mode. However, the present invention is not limited thereto. The output circuit 10 is configured to use a specific gray voltage as the test voltage VTEST, and apply the specific gray voltage to the data output lines in the checking mode.

The sensing circuit 20 senses the test voltage VTEST applied to the data output lines DOL and provides a sensing result signal RS to the timing controller TCON, the sensing result signal RS being obtained by sensing whether the data output lines DOL are shorted.

The sensing circuit 20 may compare a shared voltage of the data output lines DOL to a preset reference voltage, and provide a sensing result signal RS to the timing controller TCON, the sensing result signal RS indicating whether a short occurred. Alternatively, the sensing circuit 20 may provide a sensing result signal RS to the timing controller TCON, the sensing result signal RS being obtained by converting the shared voltage of the data output lines DOL into a digital signal.

Figure 5:
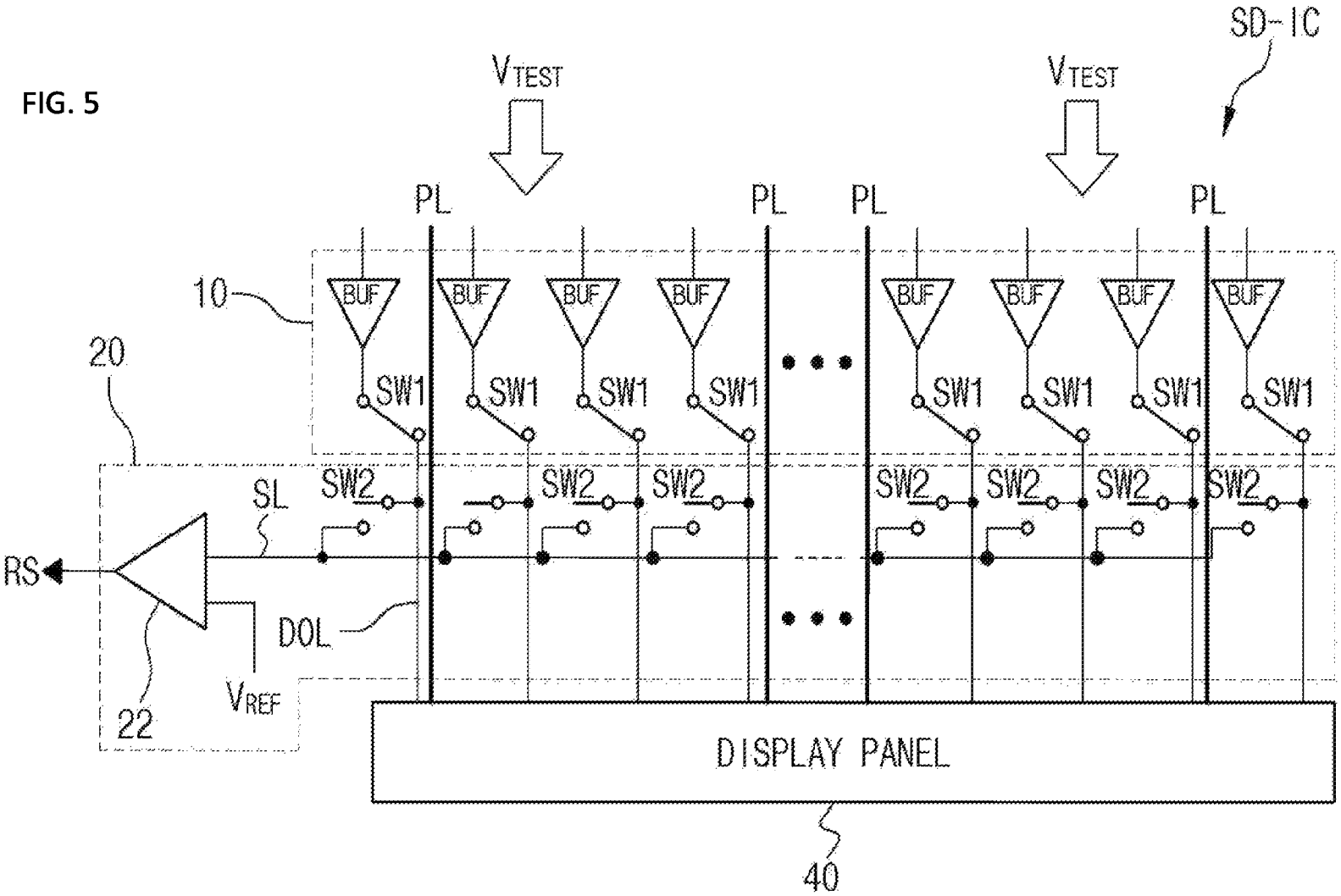
FIGS. 5 and 6 are circuit diagrams illustrating an example of the source driver of FIG. 4.
Figure 6:
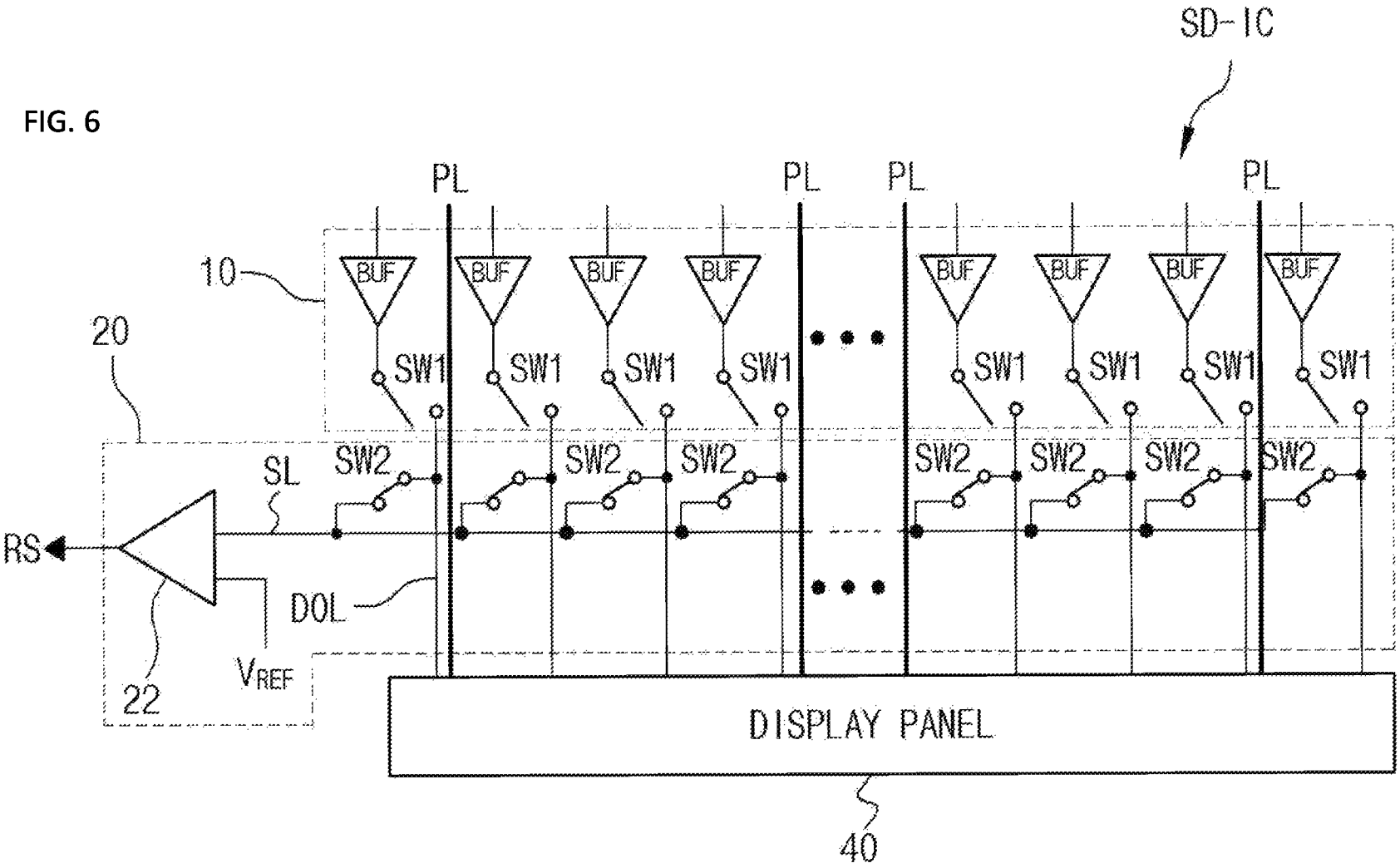

FIGS. 5 and 6 are circuit diagrams an example of illustrating the source driver of FIG. 4.

Referring to FIGS. 5 and 6, the output circuit 10 includes a plurality of output buffers BUF and switches SW1.

Each of the output buffers BUF receives a test voltage VTEST as a data voltage in the checking mode for sensing whether the data output lines DOL are shorted, and buffers the test voltage VTEST. For example, the test voltage VTEST may include a specific gray voltage set to a ground voltage or the highest gray voltage.

Each of the switches SW1 transfers the test voltage VTEST outputted from the corresponding output buffer BUT to the corresponding data output line DOL.

The sensing circuit 20 includes a plurality of switches SW2, a share line SL and a comparator 22.

The switches SW2 transfer the test voltages VEST of the corresponding data output lines DOL to the share line SL, and the test voltages VTEST of the respective data output lines DOL are shared by the share line SL.

The comparator 22 compares the shared voltage of the share line SL to a preset reference voltage VREF, and outputs a sensing result signal RS based on the comparison result. For example, the reference voltage VREF may be set to the same level as the test voltage VTEST.

Figure 7:
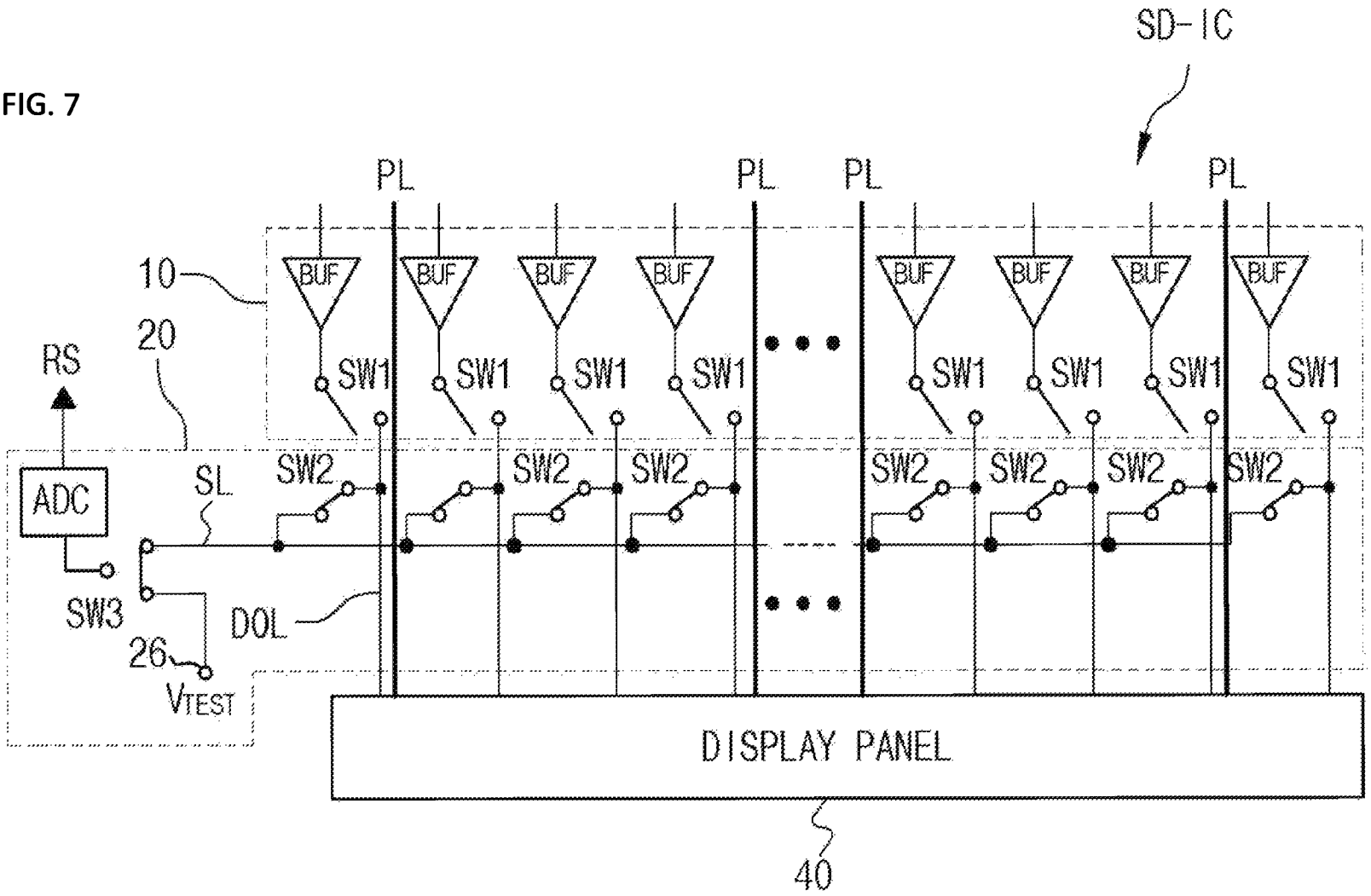
FIGS. 7 and 8 are circuit diagrams illustrating another example of the source driver.
Figure 8:
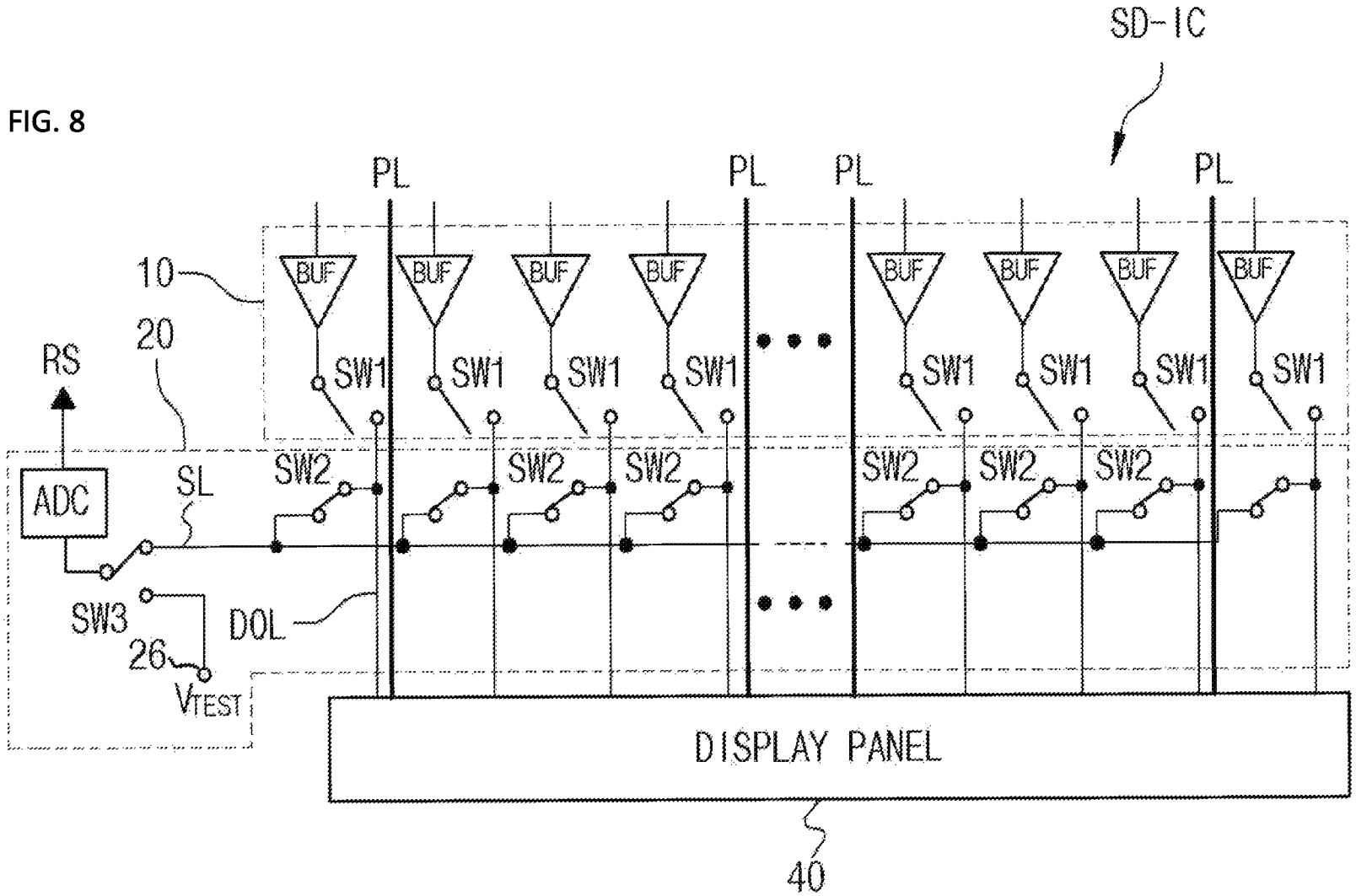

FIGS. 5 and 6 illustrate that the sensing circuit 20 includes the comparator 22. As illustrated in FIGS. 7 and 8, however, the sensing circuit 20 may include an analog-digital converter ADC instead of the comparator 22. The analog-digital converter ADC converts the shared voltage of the share line SL into a digital signal, and outputs the digital signal as a sensing result signal RS.

The operations of the output circuit 10 and the sensing circuit 20 will be described as follows.

Referring to FIGS. 5 and 6, when the test voltage VTEST is applied to the respective output buffers BUF in the checking module, the source driver SD-IC turns on the switches SW1 and turns off the switches SW2. Through the switching operations of the switches SW1 and SW2, the data output lines DOL are charged with the test voltage VTEST.

The source driver SD-IC turns off the switches SW1 and turns on the switches SW2 after a predetermined time has elapsed, thereby controlling the share line SL to share the test voltages VTEST loaded in the respective data output lines DOL. At this time, the comparator 22 compares the shared voltage of the share line SL to the reference voltage, and provides a sensing result signal RS based on the comparison result to the timing controller TCON.

FIGS. 7 and 8 are circuit diagrams illustrating another example of the source driver.

Referring to FIGS. 7 and 8, the output circuit 10 includes a plurality of output buffers BUF and switches SW1, and the switches SW1 of the output circuit 10 are turned off in the checking mode for sensing whether the data output lines DOL are shorted. The output state of the output circuit 10 is switched to a high-impedance state in the checking mode.

The sensing circuit 20 includes a common electrode 26, a switch SW3, a plurality of switches SW2, a share line SL and an analog-digital converter ADC. The sensing circuit 20 is configured to use a specific gray voltage as the test voltage VTEST, and apply the specific gray voltage to the data output lines in the checking mode.

The switch SW3 transfers the test voltage VTEST applied through the common electrode 26 to the share line SL in the checking mode, and the switches SW2 transfer the test voltage VTEST applied to the share line SL to the respective data output lines DOL. The test voltage VTEST applied through the common electrode 26 may be supplied from an internal source which supplies a gamma voltage to the digital-analog converter. Alternatively, the test voltage VTEST may be supplied as a voltage with a predetermined level from an external source.

The switch SW3 transfers the test voltage VTEST to the share line SL, and transfers the shared voltage of the share line SL to the analog-digital converter ADC when a predetermined time has elapsed.

The analog-digital converter ADC converts the shared voltage of the share line SL into a digital signal, and outputs the digital signal as the sensing result signal RS to the timing controller TCON.

For example, the source drive SD-IC may provide the sensing result signal RS to the timing controller TCON, using a sample and hold circuit which senses pixel information from the display panel 40 and the analog-digital converter ADC which provides the pixel information sensed through the sample and hold circuit to the timing controller TCON.

Furthermore, as illustrated in FIGS. 5 and 6, the source driver SD-IC may include the comparator 22 in place of the analog-digital converter ADC. The comparator 22 compares the shared voltage of the share line SL to the preset reference voltage, and provides the sensing result signal RS based on the comparison result to the timing controller ICON.

As such, the source driver SD-IC senses a potential change of the share line SL shared by the data output lines DOL, and provides the sensing result signal RS based on the potential change to the timing controller ICON.

In the embodiments of FIGS. 5 to 8, the switches SW2 are installed for the respective data output lines DOL in order to sense whether the data output lines DOL are shorted. However, the switches SW2 may be installed to correspond to the data output lines DOL adjacent to the power lines of the display panel 40, in order to sense whether the data output lines DOL are shorted.

Furthermore, in the embodiments of FIGS. 5 to 8, the comparator 22 or the analog-digital converter ADC is installed in the source driver SD-IC. However, the comparator 22 or the analog-digital converter ADC may be installed outside the source driver SD-IC, in order to sense whether a short occurred. For example, the source driver SD-IC may include the share line SL for sharing the voltages of the respective data output lines DOL, the common electrode 26 for applying the preset voltage to the share line SL, and the switches SW2 which are switched to share the voltages of the data output lines DOL and the preset voltage of the share line SL. The sensing circuit 20 senses a potential change of the share line SL outside the source driver SD-IC, and determines whether the data output lines DOL are shorted, according to the potential change of the share line SL. As such, the sensing circuit 20 may be installed outside the source driver SD-IC, in order to sense whether a short occurred.

Figure 9:
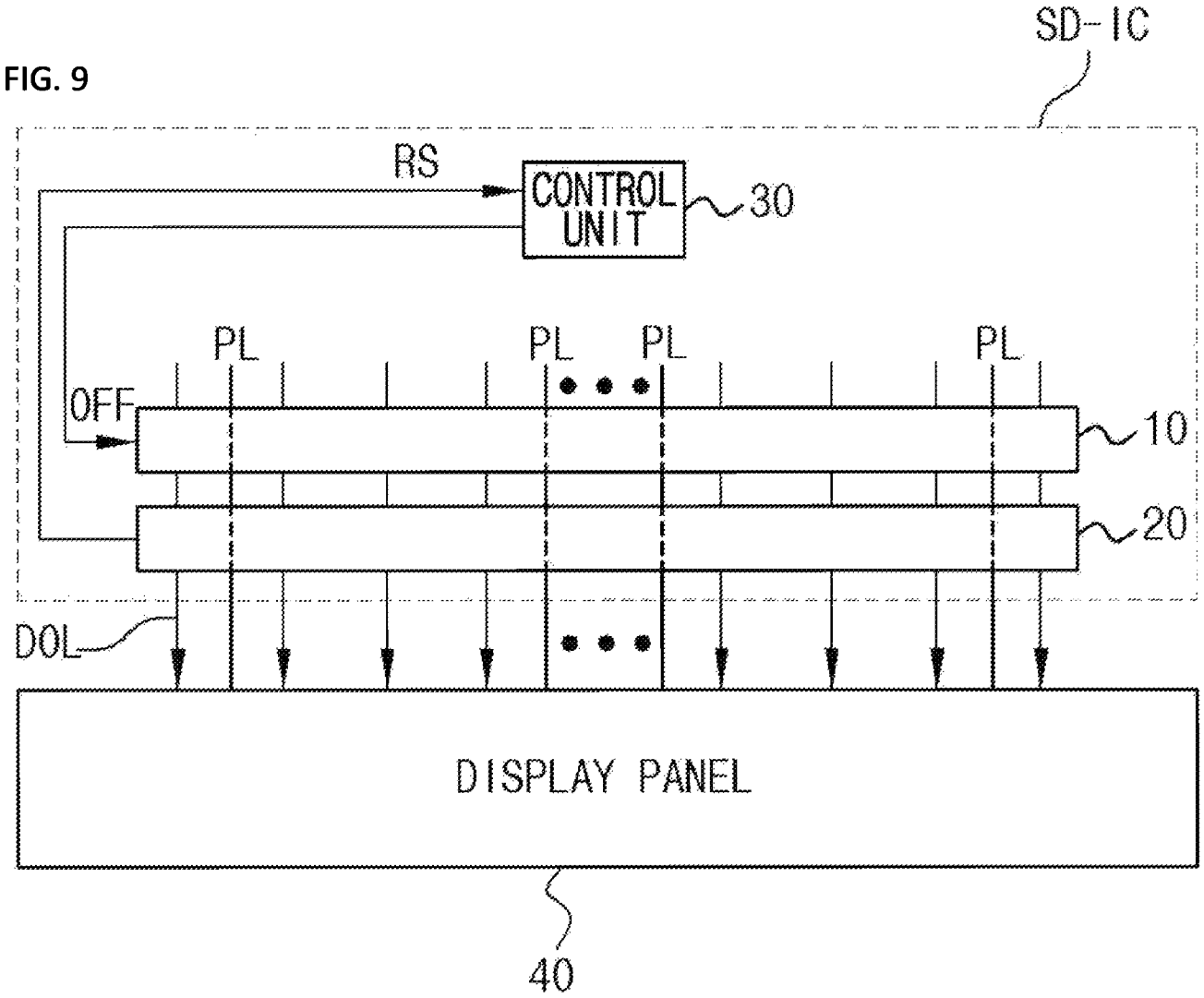
FIG. 9 is a block diagram illustrating another example of the source driver.

FIG. 9 is a block diagram illustrating another example of the source driver SD-IC.

Referring to FIG. 9, the source driver SD-IC according to the present embodiment may further include a control unit 30 configured to cut off data output of the output circuit 10, in response to the sensing result signal RS.

The control unit 30 may check the occurrence of a short in the data output lines DOL in response to the sensing result signal RS, and cut off the data output lines DOL regardless of the operation of the timing controller TCON, in order to prevent a subsequent damage such as a burn-out when a short occurred.

The source driver according to the embodiment of FIG. 9 includes the control unit 30 which is installed outside the sensing circuit 20 in order to turn off data output when a short occurs. However, the control unit 30 may be installed in the sensing circuit 20, in order to cut off data output when a short occurs.

As described above, the source driver SD-IC including the sensing circuit 20 according to the embodiment of the present invention may apply a specific gray voltage as the test voltage VTEST in order to sense whether the data output lines DOL are shorted, and sense a potential change of the specific gray voltage, thereby checking whether a short occurred between a data output line DOL and a power line PL.

Furthermore, the source driver SD-IC including the sensing circuit 20 may provide the sensing result to the timing controller ICON, and cut off data output when a short occurred, thereby preventing a subsequent damage such as burn-out.

While various embodiments have been described above, it will be understood to those skilled in the art that the embodiments described are by way of example only. Accordingly, the disclosure described herein should not be limited based on the described embodiments.

What is claimed is:

1. A source driver comprising:

an output circuit configured to output a preset voltage to all data output lines corresponding to data lines of a display panel in a checking mode; and a sensing circuit configured to sense whether or not a short occurred in the data output lines, by sharing voltages of the data output lines and comparing the shared voltage to a preset reference voltage, and output a sensing result signal indicating whether or not the short occurred in the data output lines, wherein the sensing circuit comprises:

a share line configured to share voltages of the data output lines in the checking mode, a plurality of switches configured to simultaneously connect all the data output lines and the share line to simultaneously transfer the voltages of the data output lines to the share line when the sensing circuit senses whether or not a short occurred in the data output lines, and a comparator configured to compare the shared voltage of the share line to the preset reference voltage, and provide the sensing result signal based on the comparison result to a timing controller, wherein the share line is connected to a first terminal of the comparator and the preset reference voltage is connected to a second terminal of the comparator.

2. The source driver of claim 1, wherein the output circuit is set to use a specific gray voltage as the preset voltage, and apply the specific gray voltage to the data output lines in the checking mode.

3. The source driver of claim 1, wherein the checking mode is enabled at a vertical synchronization period.

4. The source driver of claim 1, wherein the preset voltage is set at least one of a ground voltage and a highest gray voltage.

5. The source driver of claim 1, wherein the preset reference voltage is set to the same level as the preset voltage.

6. The source driver of claim 1, wherein the sensing circuit is set to share the preset voltage applied to the data output lines through the share line, and convert the shared voltage of the share line into a digital signal.

7. The source driver of claim 6, wherein the sensing circuit comprises:

a plurality of switches configured to transfer the preset voltage applied to the data output lines;

the share line configured to share the preset voltage of the data output lines, which is transferred from the switches; and an analog-digital converter configured to convert the shared voltage into a digital signal, and provide the digital signal as the sensing result signal to a timing controller.

8. The source driver of claim 1, wherein the source driver is set to sense whether the data output lines are shorted, according to a potential change of the share line which shares the preset voltage applied to the data output lines in the checking mode, and cut off the data output lines when sensing that the data output lines are shorted.

9. A source driver comprising:

a share line configured to share voltages of all data output lines of an output circuit corresponding to data lines of a display panel in a checking mode; and a sensing circuit configured to apply a preset voltage to the share line in the checking mode, check a potential change of the share line by sharing voltages of the data output lines and comparing the shared voltage to a preset reference voltage so as to sense whether or not a short occurred in the data output lines, and output a sensing result signal indicating whether or not the short occurred in the data output lines, wherein the sensing circuit comprises:

a plurality of switches configured to simultaneously connect all the data output lines and the share line to simultaneously transfer the preset voltage applied to the data output lines to the share line when the sensing circuit senses whether or not a short occurred in the data output lines, and a comparator configured to compare the shared voltage of the share line to the preset reference voltage and provide the sensing result signal based on the comparison result to a timing controller, wherein the share line is connected to a first terminal of the comparator and the preset reference voltage is connected to a second terminal of the comparator.

10. The source driver of claim 9, wherein the output circuit is set to switch an output state to a high-impedance state in the checking mode.

11. The source driver of claim 9, further comprising a control unit configured to be set to cut off data output of the output circuit in response to the sensing result signal.

12. The source driver of claim 9, wherein the sensing circuit is set to use a specific gray voltage as the preset voltage, and apply the specific gray voltage to the share line in the checking mode.

13. The source driver of claim 9, wherein the sensing circuit further comprises:

a common electrode configured to apply the preset voltage to the share line; and a transfer switch configured to transfer the preset voltage of the common electrode to the share line, or transfer the shared voltage of the share line to the comparator.

14. A display device comprising:

a source driver configured to apply a preset voltage to all data output lines of an output circuit corresponding to data lines of a display panel and share voltages of the data output lines in a checking mode; and a sensing circuit configured to check a potential change of the shared voltage of the data output lines in the checking mode, sense whether or not a short occurred in the data output lines by sharing voltages of the data output lines and comparing the shared voltage to a preset reference voltage, and output a sensing result signal indicating whether or not the short occurred in the data output lines, wherein the sensing circuit comprises:

a share line configured to share the preset voltage applied to the data output lines in the checking mode, a plurality of switches configured to simultaneously connect all the data output lines and the share line to simultaneously transfer the preset voltage applied to all of the data output lines to the share line when the sensing circuit senses whether or not a short occurred in the data output lines, and a comparator configured to compare the shared voltage of the share line to the preset reference voltage, and provide the sensing result signal based on the comparison result to a timing controller, wherein the share line is connected to a first terminal of the comparator and the preset reference voltage is connected to a second terminal of the comparator.

15. The display device of claim 14, wherein the sensing circuit determines whether or not the short occurred in the data output lines, according to the comparison result.

16. The source driver of claim 14, wherein the source driver further comprises:

a common electrode configured to apply the preset voltage to the share line in the checking mode.

* * * * *